US007194963B2

(12) United States Patent
Ganeshan

(10) Patent No.: US 7,194,963 B2
(45) Date of Patent: Mar. 27, 2007

(54) CERAMIC FIBER BLOCK REFLECTOR SYSTEM

(76) Inventor: Ram Ganeshan, 105 N. Hall Dr., Sugar Land, TX (US) 77478

( * ) Notice: Subject to any disclaimer, the term of this patent is extended or adjusted under 35 U.S.C. 154(b) by 533 days.

(21) Appl. No.: 10/248,946

(22) Filed: Mar. 4, 2003

(65) Prior Publication Data

US 2003/0121461 A1 Jul. 3, 2003

Related U.S. Application Data

(63) Continuation-in-part of application No. 09/683,215, filed on Dec. 3, 2001, now Pat. No. 6,526,898.

(51) Int. Cl.
*F23M 9/00* (2006.01)
*F28F 1/20* (2006.01)

(52) U.S. Cl. ..... 110/322; 110/323; 165/181

(58) Field of Classification Search ..... 126/655, 126/677, 657, 658, 91 A, 926, 92 C; 122/367.3; 378/144; 110/322, 323, 324, 325, 326, 336, 110/337, 341; 432/226, 210, 31, 175, 209; 165/181; 138/138
See application file for complete search history.

(56) References Cited

U.S. PATENT DOCUMENTS

| | | | | |
|---|---|---|---|---|
| 2,670,722 | A * | 3/1954 | Huet | 122/367.3 |
| 2,714,878 | A * | 8/1955 | Mekler | 122/235.11 |
| 4,142,514 | A * | 3/1979 | Newton | 126/677 |
| 4,196,716 | A * | 4/1980 | Evans et al. | 126/693 |
| 6,138,662 | A * | 10/2000 | Jones | 126/91 A |
| 6,364,658 | B1 * | 4/2002 | Ganeshan | 432/209 |

* cited by examiner

*Primary Examiner*—Kenneth Rinehart
(74) *Attorney, Agent, or Firm*—Daniel N. Lundeen; Lundeen & Dickinson, LLP

(57) ABSTRACT

The present invention utilizes radiation reflectors on the refractory wall of a fired furnace opposite the spaces between adjacent tubes. The refractory radiation reflectors have a base contiguous with the refractory surface and secured to a subjacent structure, and an isosceles triangular cross section with similar sides extending from the base. The base has a dimension less than the spaces between adjacent tubes to facilitate installation in a modular construction. The radiation reflectors focus the reflected radiation from the flame onto the dark side of the tubes. The invention increases the overall heat transfer of the tube by increasing the heat flux rate for the backside of the tube, and also decreases the flux and temperature differentials between the front and rear sides of the tubes.

22 Claims, 8 Drawing Sheets

CASE A (2D SPACING)
AVERAGE FLUX = 10,000 BTU/HR-SQFT

CASE B (3D SPACING)
AVERAGE FLUX = 12,000 BTU/HR-SQFT

CERAMIC FIBER BLOCK REFLECTOR SYSTEM

CROSS REFERENCE TO RELATED APPLICATIONS

This invention is a continuation-in-part of application U.S. Ser. No. 09/683,215 filed Dec. 3, 2001, now U.S. Pat. No. 6,526,898.

BACKGROUND OF INVENTION

The present invention is directed to reflectors used in the radiant section of a fired heater, and more particularly to ceramic reflectors provided on a refractory wall centered in the spacing between the radiant tubes.

Combustion equipment is generally operated in chemical plants, petrochemical plants and refineries. The equipment may include industrial heaters, furnaces or plant boilers. This equipment is generally designed with bare or smooth-walled tubes, or with partially studded tubes as disclosed in my U.S. Pat. No. 6,364,658, which is hereby incorporated by reference in its entirety. Use of tubes in radiant sections usually exposes the front half of the tube to direct flame radiation, while limiting the exposure of the rear half or dark side of the tube to reflected radiation.

The heat flux distribution around the circumference of a conventionally fired tube at a conventional spacing of two tube diameters is depicted in FIG. 1. A flame or radiating plane is on one side of the tube and a refractory wall is on the other. The front half of the tube surface faces the flame (point A) and receives a higher heat flux as compared to the rear half facing the refractory wall (point B). Point A receives heat flux only from direct flame radiation, while point B, facing the refractory wall, receives only reflected radiation coming from the refractory wall. Points between point A and point B receive varying amounts of both direct and reflected radiation, depending upon their location along the tube.

The standard distance between tubes is two tube diameters from center-to-center, and 1.5 diameters from the center of the tubes to the refractory wall, for most operations in the chemical and petrochemical industries, as shown in FIG. 2. The heat flux distribution in FIG. 1 is based on this configuration. For the purposes of an illustration using fluxes typical in a conventional fired heater, where the highest heat flux at point A is 18000 Btu/hr-ft$^2$, the diametrically opposed counterpart (point B) receives only 6000 Btu/hr-ft$^2$. The rear half of the tube transfers only 24% of the total heat absorbed by the tube; this includes both the direct and reflected radiation, as seen in FIG. 3. The average flux for the tube amounts to 10,000 Btu/hr-ft$^2$.

More than 85% of the heaters in the industry have such a large flux differential between the front and the rear side of the tube, as this illustration depicts. A significant compromise is made on the overall heat-receiving capacity of the tube in order to keep the flame-front side (point A) within safe working temperatures.

To make the heat flux distribution in the tube more uniform, one approach of the furnace designers has been to increase the center-to-center tube spacing requirements from 2 to 3 tube diameters. This design increases the flux at point B of the tube from 6,000 Btu/hr-ft$^2$ to 9,000 Btu/hr-ft$^2$ as shown in FIGS. 4A and 4B. The increased spacing has the beneficial result of increasing the heat-receiving capacity of the rear half of the tube for the 3D-spaced tubes, while heat flux distribution on the front half of the tube is generally the same as for the 2D-spaced tubes. This results in an increase of the average heat flux to 12,000 Btu/hr-ft$^2$ for the entire tube. However, the drawback of this solution is apparent. With an increase in tube spacing there is a corresponding increase in the size of the heater. This increases the cost and space requirements for the heater.

Another prior art approach improves the heat flux distribution by placing radiating flames on opposing sides of the tubes in a so-called "double-fired" design. A comparison is shown between one radiating flame (A) and two radiating flames (B) in FIGS. 5A and 5B, respectively. This design is commonly used in chemical processes that mandate a more uniform heat flux distribution, such as, for example, in delayed cokers, high-pressure hydrotreaters, ethylene furnaces, and the like. In a double-fired system, the front (point A) and rear (point B) portions of the tube have the same heat flux rate due to direct flame radiation, and the points at the margins between the front and rear receive relatively less direct flame radiation. The corresponding distribution of the heat flux, for the illustrative example, is 18,000 Btu/hr-ft$^2$ for the front and the rear locations, 13,500 Btu/hr-ft$^2$ at the margins between the front and rear faces, i.e. the middle area of the tube (point M at the 90 and 270 degree positions), resulting in an average flux of 15,000 Btu/hr-ft$^2$. The double-fired design brings with it the disadvantage that the heater has to be much larger, as much as twice the size as a single-fired unit, and correspondingly more expensive.

The present state of technology for heaters with a standard spacing of 2 tube-diameters will have a relative flux ratio of 1 to 1.8 between the average flux and the maximum flux, whereas a heater with a 3 tube-diameter spacing will have a relative flux ratio of 1 to 1.5, as shown in API Standard 530, *Calculation of Heater-Tube Thickness in Petroleum Refineries*, American Petroleum Institute (1988), Figure C-1 Ratio of Maximum Local to Average Heat Flux Curves, page 103.

The 3 tube-diameter design is less common in the industry and the vessel must be significantly larger than a 2 tube-diameter design. The average to maximum flux ratio of the double-fired tubes is significantly lower at 1 to 1.2, but is a more costly alternative of the three designs for an industrial plant.

A recent improvement in the flux distribution as described in my "458 patent involves the placement of extended surfaces such as studs or fins on the dark side of the tubes in a single-fired arrangement. This improves the heat transfer to the dark side of the tubes primarily by increasing the convection heat transfer. Still, in the standard tube arrangement with smooth walls, it is well known that 65.8% of the radiant heat from the flame is absorbed by the tubes, primarily the front half of the tubes facing the flame, and 34.2% goes through the spaces between the tubes to the refractory wall. The same percentages apply to the reflected radiation from the refractory onto the dark side of the tubes, i.e. 65.8% of the 34.2% is re-radiated to the rear half of the tubes, or 22.5%. In other words, 88.3% is absorbed by the tubes, front and back, and the balance of 11.7% is radiated back to the flame through the spaces between the tubes. It would be very desirable if a significant portion of this 11.7% could be directed onto the tubes instead of the flame. There thus remains a need for making the flux distribution even more uniform and/or for increasing the rate of heat absorption by the tubes.

SUMMARY OF INVENTION

The present invention utilizes radiation reflectors positioned on the refractory wall of a furnace, preferably in the spaces between the radiant tubes. The radiation reflectors provide surfaces which are angled, with respect to generally flat or curvilinear refractory surfaces behind the tubes, to reduce the radiation that is reflected between the tubes and increase the radiation reflected onto the dark side of the tubes. The use of the radiation reflectors thus increases the radiant flux delivered to the dark side of the tubes, increasing heat absorption and decreasing the ratio of the maximum to average flux. The radiation reflectors can also enhance convection heat transfer to the dark side of the tubes by increasing the velocity of the flue gases between the tubes and the refractory wall, thereby increasing the convection heat transfer.

In one aspect, the present invention provides radiation reflectors for use in a fired furnace comprising a plurality of parallel tubes arranged in a row between a flame on a radiant side and a generally flat or curvilinear refractory surface on a dark side. The radiation reflectors have a longitudinal base for abutment against the refractory surface. The base has opposite edges at either side thereof. A longitudinal cusp is opposite the base, and longitudinal reflective surfaces extend from each edge of the base to the cusp. The reflective surfaces have concavity in a plane transverse to a longitudinal axis, preferably parabolic sections in the transverse plane. An anchoring pin can extend transversely through each radiation reflector from the cusp into a subjacent structure.

In another aspect, the invention provides a fired furnace for heating petroleum, petrochemicals or chemicals. The furnace has a plurality of parallel tubes each disposed in a row between a flame on a radiant side thereof and a refractory surface on a dark side thereof. There are spaces between adjacent tubes. Radiation reflectors are positioned on the refractory surface opposite the spaces to reflect incident radiation from the flame away from the spaces and onto the dark side of the tubes. A central longitudinal bore is provided through each tube for the passage therethrough of a fluid to be heated. The row of tubes can be straight or circular. The radiation reflectors can be disposed longitudinally on either side of a flat surface of the refractory surface opposite a tube.

In a further aspect, the invention provides an improvement in a fired furnace. The furnace includes a plurality of parallel tubes disposed between a flame and a refractory wall. Adjacent tubes define a space between the tubes, and each tube includes a central longitudinal bore for the passage therethrough of a fluid to be heated and an outside diameter having a radiant side for exposure to radiation from the flame and a dark side essentially free of direct exposure to the flame. The improvement comprises positioning the radiation reflectors described above on the refractory wall opposite each space. Preferably, the reflective surfaces are parabolic sections in the transverse plane focused on the dark side of the adjacent tubes.

In a still further aspect of the invention, there is provided a method for improving the heat transfer in a fired furnace comprising a plurality of parallel tubes disposed between a flame and a refractory wall. Adjacent tubes define spaces between the tubes. The refractory wall comprises a generally flat or curvilinear surface opposite the tubes and spaces. The method includes the step of installing the radiation reflectors described above on the refractory wall opposite the spaces. The installation can include pinning the radiation reflectors with a pin extending from the cusp into the refractory wall. The radiation reflectors are preferably focused to reflect incident radiation from the flame onto the adjacent tubes on either side of a respective space. The tubes can have extended surfaces at least on the dark side. Where the tubes have smooth outside walls, the method can also include removing the smooth-walled tubes from the furnace and replacing them with tubes that have extended surfaces on a dark side opposite the refractory.

A further aspect of the invention is the provision of ceramic fiber block modules that can be readily attached to add enhanced reflective functionality a flat planar or curvilinear refractory wall. The modules have a preferably isosceles triangular cross section with a relatively short base and similarly angled sides, and a plurality of anchors having a first end fixed in the ceramic fiber block and extending to a second end protruding from the base. The height of the triangle is preferably greater than the base dimension. The base of the triangle is preferably less than the spacing between adjacent tubes to allow the module to be passed therebetween. The ends of the modules are adapted for end-to-end abutment, e.g. matching flat surfaces.

DETAILED DESCRIPTION

Figure 1:
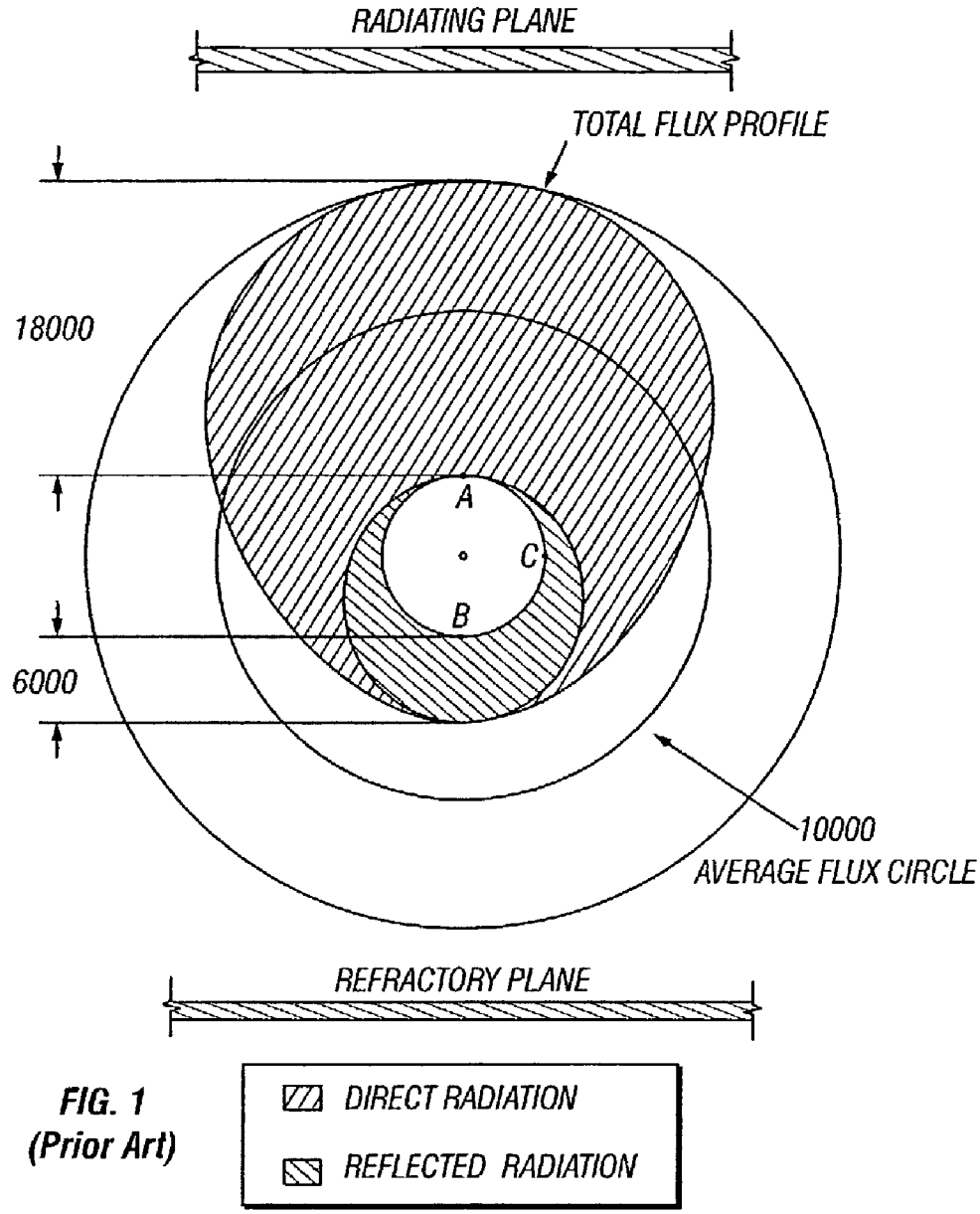
FIG. 1 (Prior Art)
FIG. 1 is a simplified schematic of the heat flux influence on tubing using a single radiating plane with an accompanying refractory wall.
Figure 2:
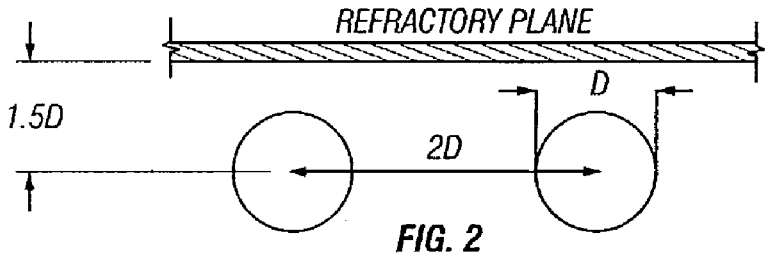
FIG. 2 (Prior Art)
FIG. 2 is a simplified schematic of the standard spacing between tubes.
Figure 3:
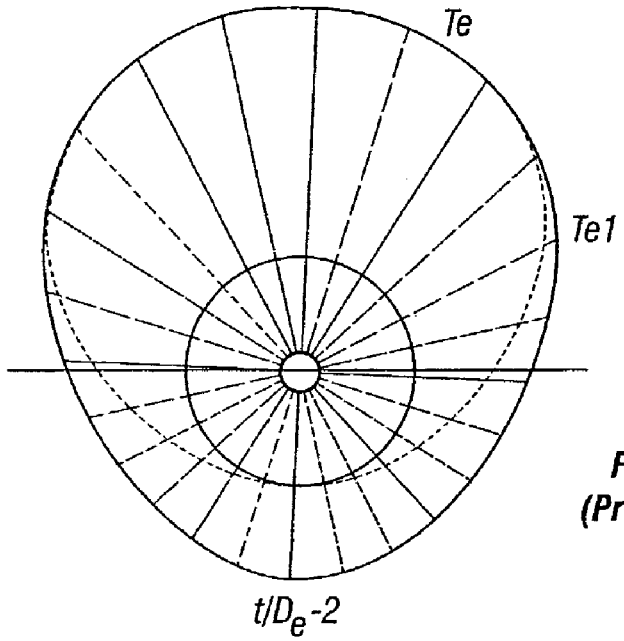
FIG. 3 (Prior Art)
FIG. 3 is a simplified schematic comparing the heat flux received on opposing sides of the tubing.
Figure 4A:
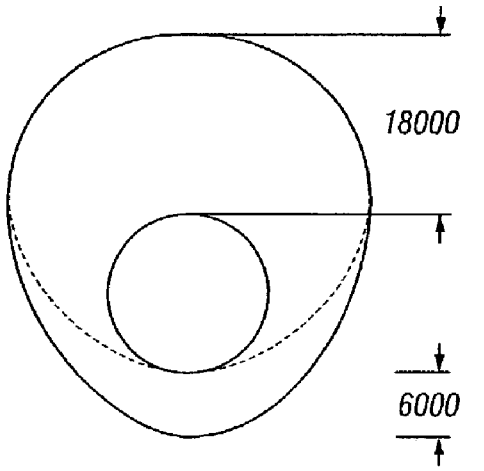
FIG. 4A (Prior Art)
FIG. 4 is a simplified schematic comparing the relative heat flux distribution based on different tube spacing.
Figure 4B:
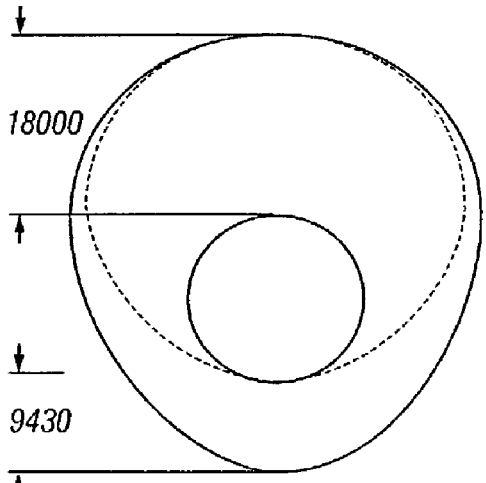
FIG. 4B (Prior Art)
Figure 5A:
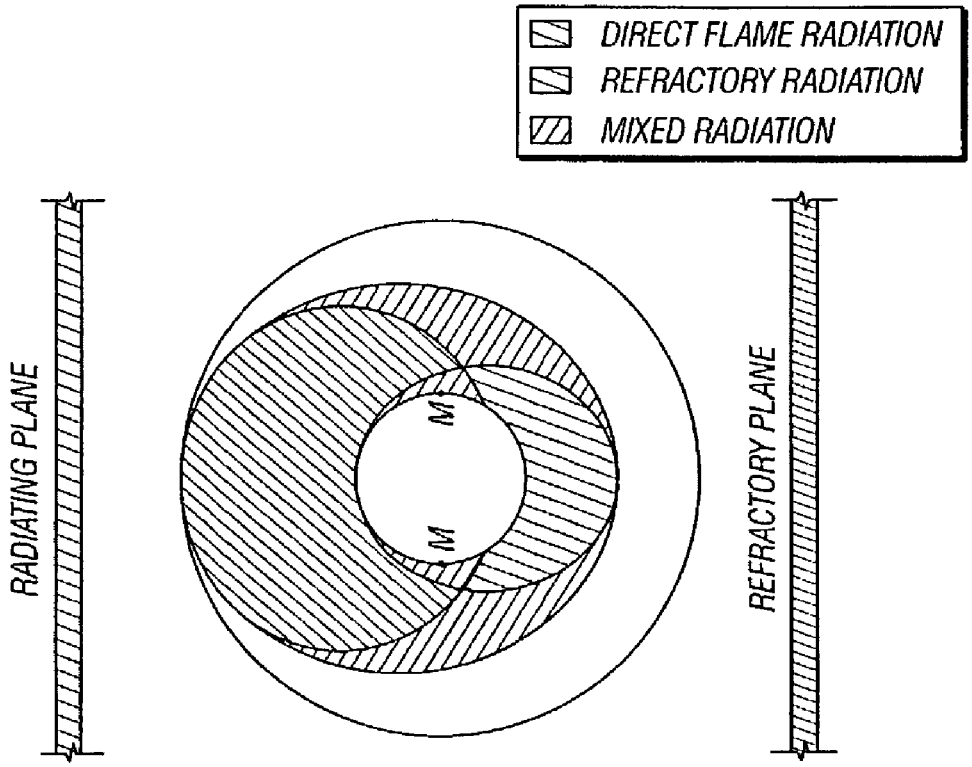
FIG. 5A (Prior Art)
FIGS. 5A and 5B are simplified schematics comparing the heat flux influence on tubing using a single radiant plane (FIG. 5A) to a double radiant plane (FIG. 5B).
Figure 5B:
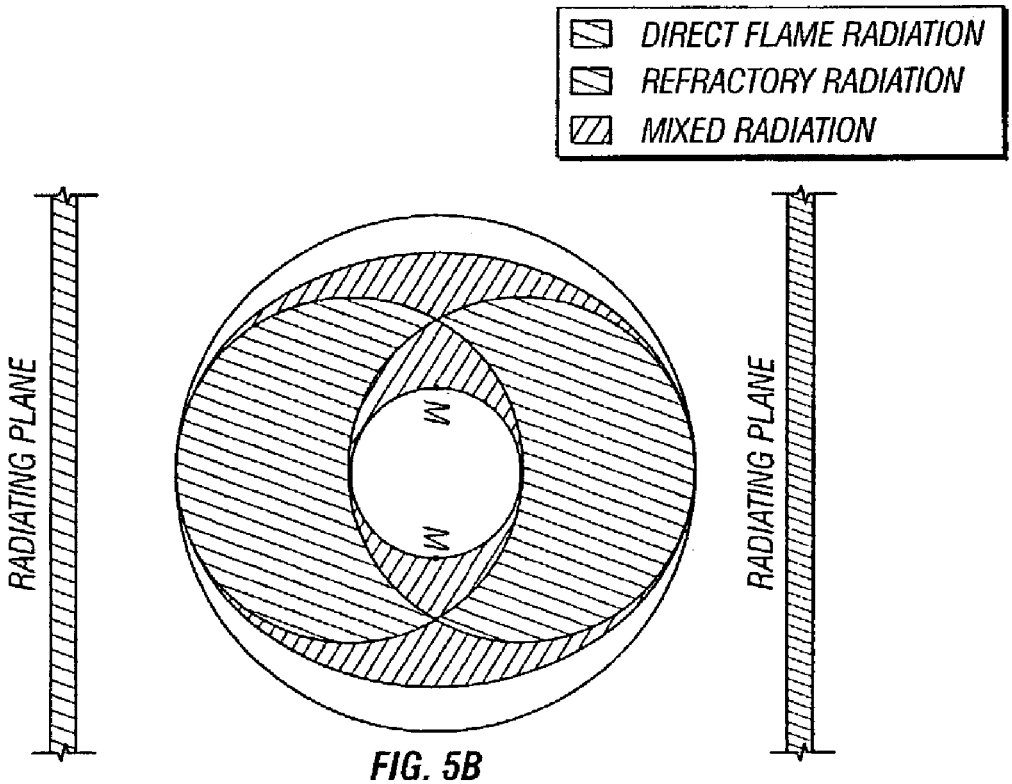
FIG. 5B (Prior Art)
Figure 6:
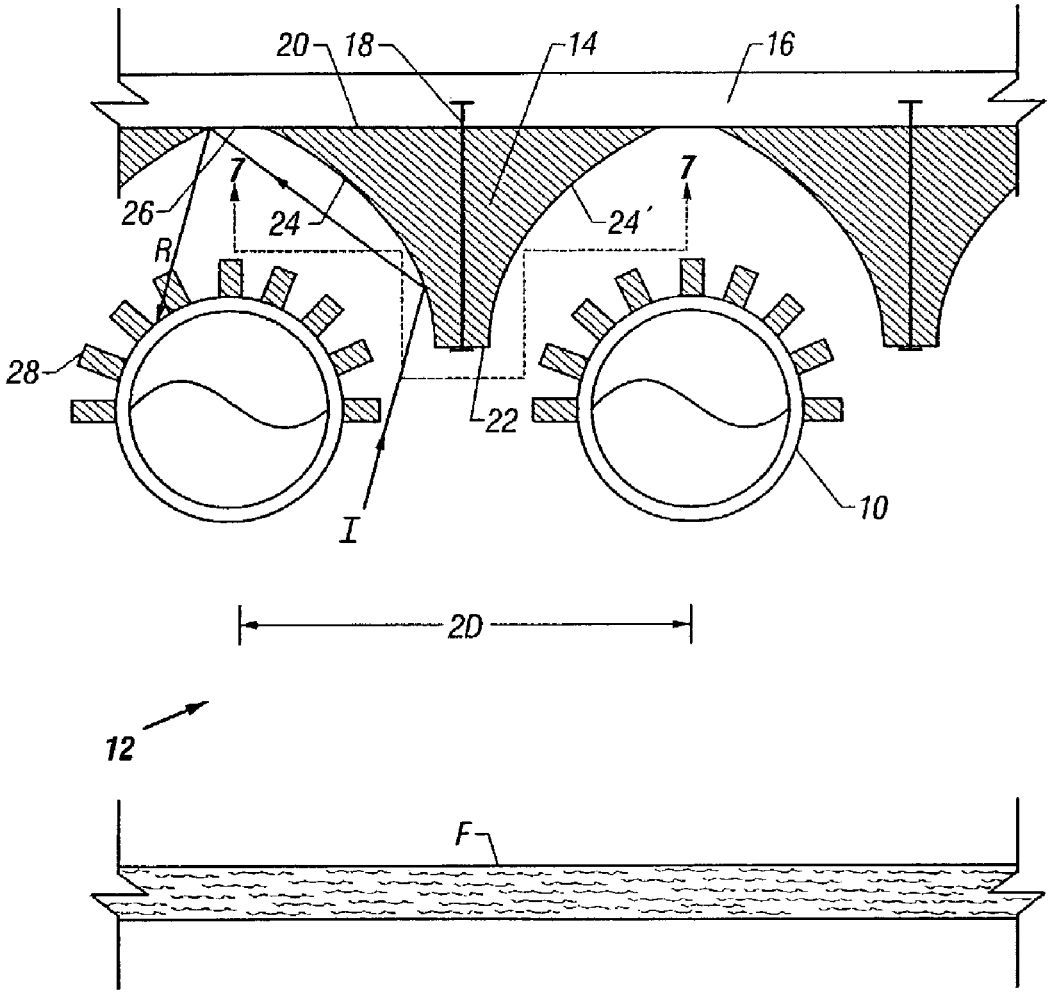
FIG. 6 is a simplified schematic plan of radiation reflectors installed on the refractory wall in the space between the adjacent tubes according to the invention wherein the tubes are arranged in a linear row.
Figure 7:
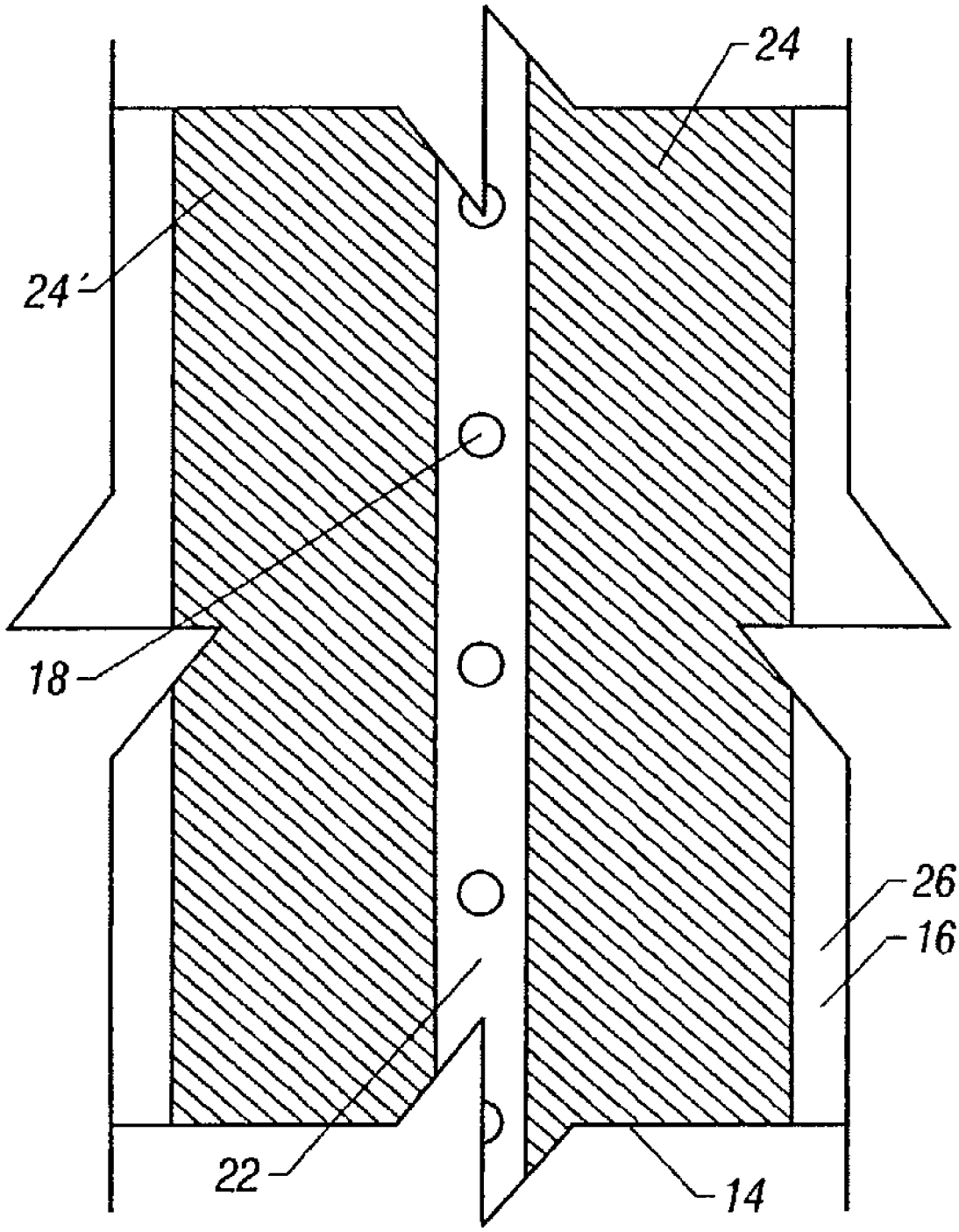
FIG. 7 is a front perspective view of the radiation reflectors of FIG. 6.
Figure 8:
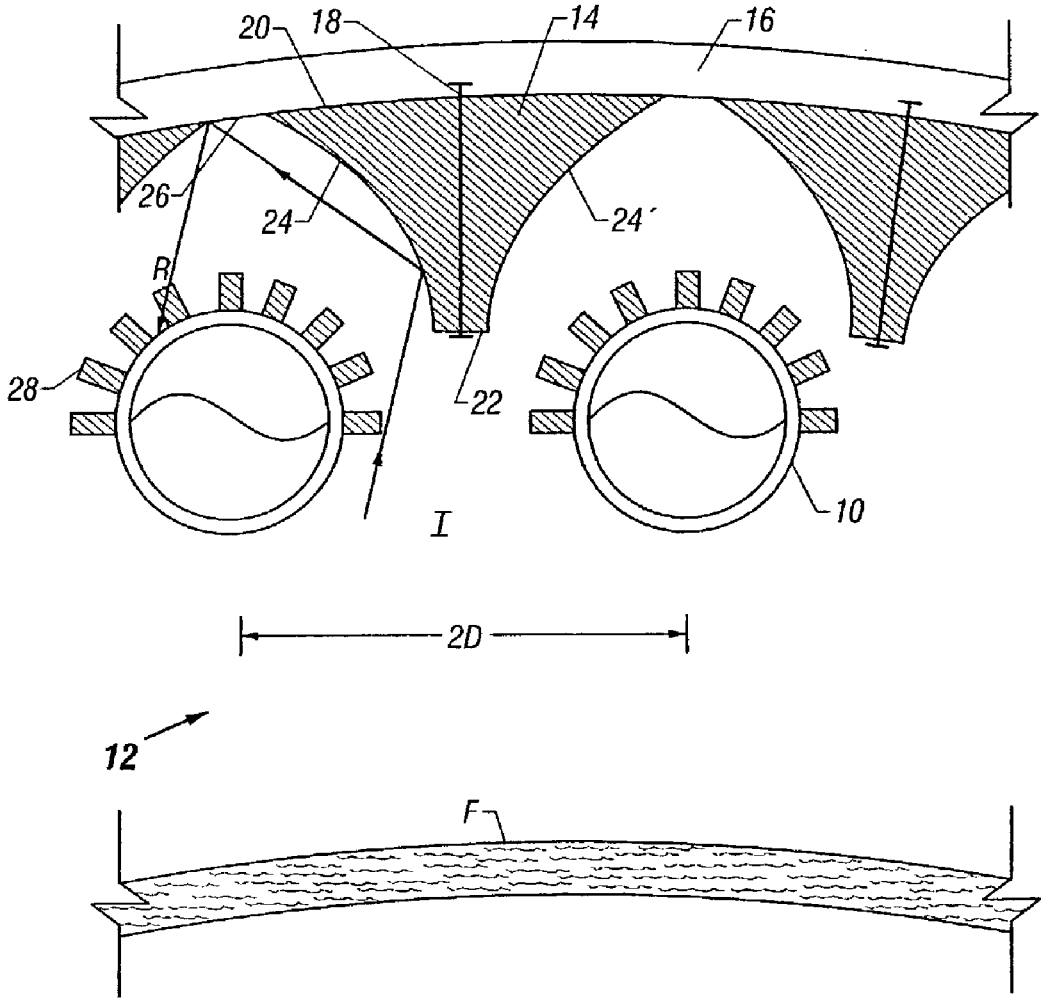
FIG. 8 is a simplified schematic plan of radiation reflectors installed on the refractory wall in the space between the adjacent tubes according to the invention wherein the tubes are arranged in a circular row.
Figure 9:
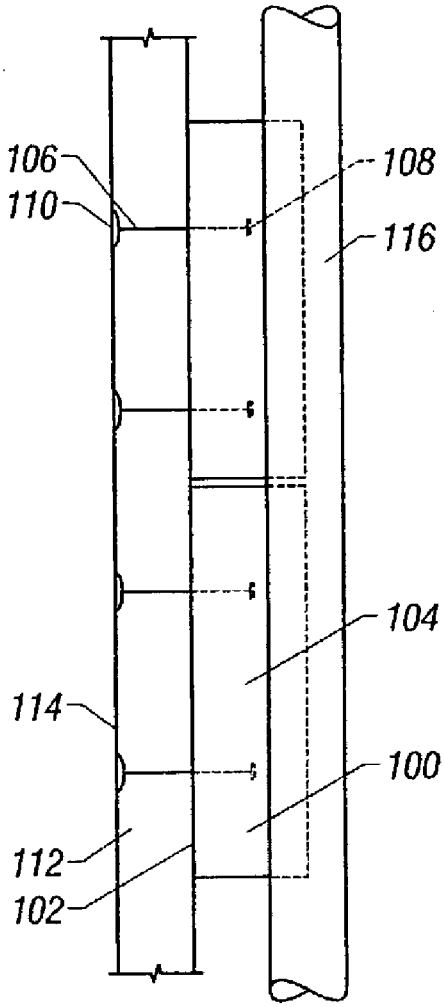
FIG. 9 is a side view, partly in section, of an elevation of ceramic fiber block modules installed in a radiant furnace according to another embodiment of the invention.

As illustrated in FIGS. 6–8, the present invention enhances the heat transfer rate to the dark side of the tubes 10 in a fired furnace 12 by using radiation reflectors 14 between the tubes 10. The radiation reflectors 14 are secured against the refractory wall 16 by means of a transverse pin 18, for example. The radiation reflectors 14 are made of a conventional cast or shaped refractory material, using conventional casting and/or shaping methodologies and equipment. The radiation reflectors 14 can be prefabricated, or cast or shaped in place (field fabrication). The radiation reflectors 14 can be installed in a new furnace as part of the original design, or can be installed in an existing furnace during scheduled shutdown for other servicing or maintenance or a shutdown for the specific purpose of installing the radiation reflectors 14.

The radiation reflectors 14 are longitudinally oriented and coextensive with the tubes 10 and/or the refractory wall 16, taking the form of corbels in the case of vertically oriented tubes 10. The radiation reflectors 14 are positioned opposite a gap or space between the adjacent tubes 10. The radiation reflectors 14 have a base 20, a cusp 22, and opposing reflecting surfaces 24,24" between either end of the base 20 and the cusp 22. The base 20 desirably has a contour matching that of the refractory wall 16, i.e. it is preferably flat in the case of a flat refractory wall (see FIG. 6), and curved in the case of a curvilinear refractory wall 16 (see FIG. 8). The cusp 22 is preferably as pointed as possible to maximize reflection away from the spaces, or it can be flattened as necessary to facilitate fabrication and/or pinning of the radiation reflectors 14.

The reflecting surfaces 24,24" preferably have a concave shape as viewed in a transverse plane, for example, a parabolic section. This shape helps the incident radiation I from the flame front F to be reflected at R primarily onto the dark side of the tubes 10, as well as adjacent respective reflecting surfaces 24",24 and/or optional intermediate flats 26 (which can be curvilinear) from which it is subsequently reflected mostly onto the dark side of the tubes 10. Although there will still be minor losses of reflected radiation R through the spaces between the tubes 10, these will be relatively minor compared to the losses in the case of the conventional flat (FIG. 6) or curvilinear refractory wall 16 (FIG. 8) without the radiation reflectors 14. The reflecting surfaces 24,24" thus serve to focus the reflected radiation R onto the dark side of the tubes 10, in that less of the reflected radiation R escapes through the spaces between the tubes 10.

If desired, the tubes 10 can be either horizontal or vertical or sloped between horizontal and vertical. Also, the tubes can be provided with extended surfaces such as studs 28 on the dark side of the tubes 10 as described in my earlier "658 patent mentioned above. For example, for 4-in. OD tubes 10, studs 28 measuring 0.5-in. in diameter and 0.75-in. long can be welded with a broad-based, bell-shaped 100% contact weld attachment at 9 studs per row staggered with 8 studs per row, 19 rows per foot of length. This leaves 3.25-in. between the tip of the closest stud 28 and the opposing flat 26. The combination of studs 28 and radiation reflectors 14 is a preferred embodiment that is particularly effective in increasing the overall heat transfer. The tubes 10 can be arranged in any conventional configuration, such as for example, in a straight row, in which case the refractory wall 16 and the flats 26 are typically planar (see FIG. 6), or in a circular plan, in which case the refractory wall 16 and flats 26 have curvature (see FIG. 8), or the like.

The radiation reflectors 14 serve to enhance the radiation heat transfer to the dark side of the tubes by selectively focusing the reflected radiation R, as described above. For a given maximum flux on the radiant side of the tubes 10, the overall radiation heat transfer is improved and the difference between the radiant and dark side radiant absorption fluxes is thereby reduced with its concomitant advantages of reduced thermal stresses, less bowing of the tubes 10, longer tube life, etc. In addition, the radiation reflectors 14 serve to enhance the convection heat transfer to the dark side of the tubes 10 in two ways. First, by reducing the cross-sectional area available for the flow of flue gases between the tubes 10 and the refractory wall 16, the velocity of the circulating downdraft gases against the tubes 10 is increased, thereby improving the turbulence and the convective heat transfer coefficient. For example, for 6-in. tubes 10 on a 2D spacing with 1.5D spacing from the refractory wall 16, using corbels having a base 20 of 8-in. and a height of 6-in. from the base to the cusp 22, the radiation reflectors 14 will reduce the free flow area between the tubes 10 and the refractory wall 16 by 26 percent. Second, the convective heat transfer is improved by directing the flow of the circulating downdraft gases onto the dark side of the tubes 10. The improved convective heat transfer further enhances the concomitant advantages of the improved radiant heat transfer mentioned above.

The idea of the radiation reflectors 14 is to prevent all or at least most of the 11.7% re-radiation losses from the refractory walls through the spaces between the tubes 10 that occurs in the conventional flat-walled furnace arrangement. The reflecting surfaces 24,24" in the present invention serve to trap the radiation losses and focus them onto the tubes 10. If the cusp 22 is an ideal pointed design, close to 100% recovery can be achieved, but a practical design to anchor the radiation reflectors 14 may need a flat space for the anchoring pin 18. Even if the efficiency loss is 10% because of the flat space for the pin 18, it can be expected that 90% of the 11.7%, or roughly 10% of the flame radiation will be captured as additional heat by the tubes 10, primarily on the dark side facing the refractory wall and the radiation reflectors 14. Compared to the 22.5% of the flame radiation captured on the dark side of the tubes 10 in a conventional design, this is roughly a 45% increase in the reflected radiant heat impinging on the dark side of the tubes 10.

Figure 10:
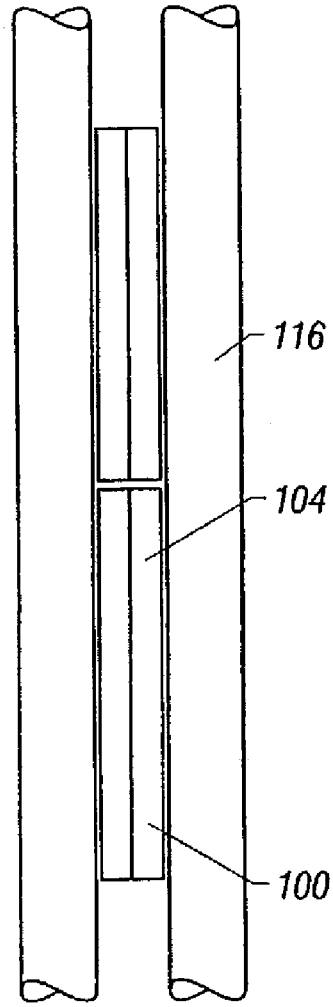
FIG. 10 is a front view of the installed ceramic fiber block modules of FIG. 9.
Figure 11:
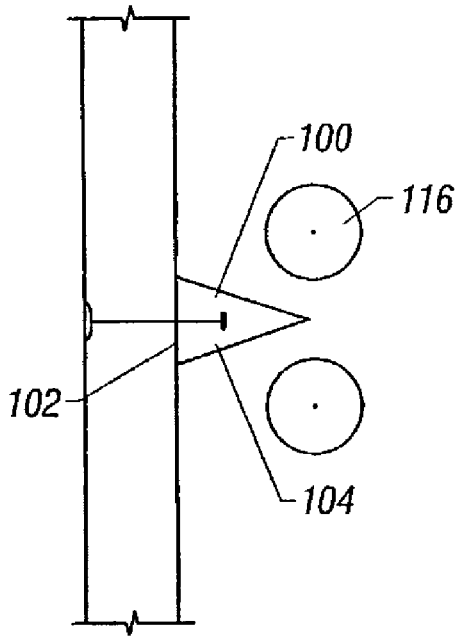
FIG. 11 is a cross sectional view of the installed ceramic fiber block modules of FIGS. 9 and 10.
Figure 12:
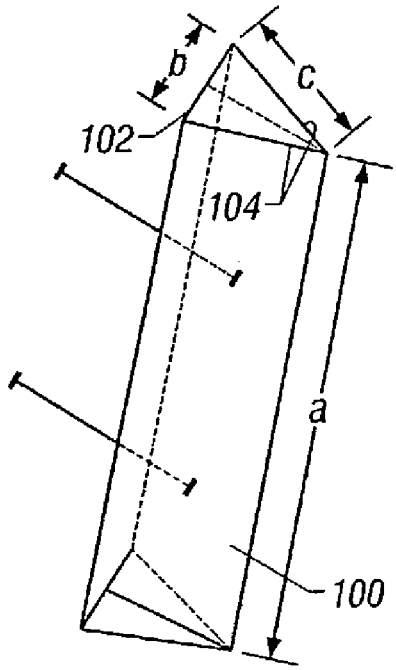
FIG. 12 is a perspective view of the ceramic fiber block modules of FIGS. 9–11.

Another embodiment of the invention is shown in FIGS. 9–12. This embodiment is advantageous for facilitating installation of the ceramic fiber blocks 100, either in a new furnace or in a retrofit of an existing furnace. The blocks 100 are modules constructed of a conventional ceramic fiber block material well known in the art, having a cross section in the form of an isosceles triangle with the base 102 and similar sides 104. Anchors 106 have a first end 108 with a transverse projection within the body of the block 100, and a second end 110 extending from the base 102 for passing through the refractory lining 112 for welding or other attachment to the casing steel 114. The anchors can have a spacing of for example, every 1 to 3 feet. The height of the block 100 is preferably greater than the spacing of the tubes 116 from the refractory lining 112 so that the tip edge of the block 100 extends into the gap between the adjacent tubes, more preferably terminating at about the plane defined by the centers of the tubes 116. The width of the base 102 should be less than the spacing between the adjacent tubes 116 as best seen in FIG. 10. The opposite ends of the blocks 100 have matching profiles so that they can be positioned in end-to-end abutment in the furnace. The blocks 100 can have a length of from 6 to 8 feet to facilitate handling and transportation, whereas the dimensions of the triangular faces will vary according to the tube size, spacing and heater design.

The ceramic fiber blocks 100 are installed as prefabricated modules that are shipped to the furnace location. The blocks 100 are each passed between adjacent tubes 116 and placed with the base 102 in abutment with the radiating surface of the refractory wall 102. Where the refractory wall is curvilinear, the base 16 can be slightly curved to have a matching profile, but this is not essential. The anchors 106 are passed through bores formed in the refractory wall 102 and/or casing steel 114, and the ends 110 are welded or bolted to the casing steel 114 to hold the blocks 100 tightly and securely in place.

The invention is described above with reference to specific embodiments solely for the illustration of the invention and not by way of limitation. Various modifications of the specific embodiments will occur to the skilled artisan in view of the above disclosure. All such modifications within the scope and spirit of the appended claims are intended to be embraced thereby.

The invention claimed is:

1. A fired furnace, comprising:

a plurality of parallel tubes each disposed in a row between a flame on a radiant side thereof and a refractory surface on a dark side thereof wherein the refractory surface is spaced from the tubes;

spaces between adjacent tubes for radiation from the flame to the refractory surface;

refractory radiation reflectors positioned longitudinally on the refractory surface opposite the spaces to reflect incident radiation from the flame away from the spaces and onto the dark side of the tubes, wherein the refractory radiation reflectors have a base contiguous with the refractory surface and secured to a subjacent structure, an isosceles triangular cross section with similar sides extending from the base, wherein the base has a dimension less than the spaces between adjacent tubes;

a central longitudinal bore through each tube for the passage therethrough of a fluid to be heated.

2. The furnace of claim 1 wherein the row is straight.

3. The furnace of claim 1 wherein the row is circular.

4. The furnace of claim 1 comprising at least one anchoring pin with a first end secured in a body of the radiation reflectors and extending through the base into a subjacent structure.

5. The furnace of claim 1 wherein the similar sides meet at an edge disposed in the spaces between adjacent tubes.

6. Refractory radiation reflector having utility in a fired furnace comprising a plurality of parallel tubes arranged in a row between a flame on a radiant side and a generally flat or curvilinear refractory surface on a dark side, comprising:

a longitudinal base for abutment against the refractory surface, the base having opposite edges at either side thereof;

a longitudinal cusp opposite the base for positioning in spaces between adjacent ones of the parallel tubes;

longitudinal reflective surfaces extending from each edge of the base to the cusp, the reflective surfaces defining an isosceles triangular cross section with the base;

at least one anchor having a first end secured within a body of the reflector and a second end extending form the base for securing the reflector to a structure in the fired furnace.

7. In a fired furnace comprising a plurality of parallel tubes disposed between a flame and a refractory wall, adjacent tubes defining a space between the tubes, each tube including a central longitudinal bore for the passage therethrough of a fluid to be heated and an outside diameter having a radiant side for exposure to radiation from the flame and a dark side having limited direct exposure to the flame, the improvement comprising:

radiation reflectors positioned on the refractory wall respectively opposite the spaces, wherein the radiation reflectors comprise:

a longitudinal base for abutment against the refractory surface, the base having opposite edges at either side thereof and a dimension less than the space between the tubes;

a longitudinal cusp opposite the base disposed within the space between the tubes;

longitudinal reflective surfaces extending from each edge of the base to the cusp, the reflective surfaces forming in cross section an isosceles triangle with the base.

8. A method for improving the heat transfer in a fired furnace comprising a plurality of parallel tubes disposed between a flame and a refractory wall, adjacent tubes defining spaces between the tubes, the refractory wall comprising a generally flat or curvilinear surface opposite the tubes and spaces, comprising:

installing refractory radiation reflectors on the refractory wall opposite the spaces, wherein the radiation reflectors comprise:

a longitudinal base for abutment against the refractory surface, the base having opposite edges at either side thereof and a dimension less than spaces between the tubes;

a longitudinal cusp opposite the base disposed in the spaces between the tubes;

longitudinal reflective surfaces extending from each edge of the base to the cusp, the reflective surfaces in cross section forming an isosceles triangle with the base.

9. The method of claim 8 wherein the installation comprises pinning the radiation reflectors with a pin extending from a body of the radiation reflectors into the refractory wall.

10. The method of claim 9 wherein the pins extend through the refractory wall to an end for securing to a casing of the furnace.

11. The method of claim 10 wherein the installation includes passing the base of the radiation reflectors through the spaces between the tubes, placing the bases in abutment with the generally flat or curvilinear surface, passing the pins through the refractory lining and securing the ends of the pins to the furnace casing.

12. The furnace of claim 1, wherein the tubes have extended surfaces at least on the dark side.

13. The method of claim 8 wherein the tubes have smooth outside walls and the method further comprises removing the smooth-walled tubes from the furnace and replacing them with tubes that have extended surfaces on a dark side opposite the refractory.

14. The furnace of claim 1 wherein the tubes are on a 2-diameter center-to-center spacing.

15. The furnace of claim 14 wherein the tubes are spaced 1.5 diameters from a center of the tubes to the refractory wall.

16. The furnace of claim 1 wherein the tubes are on a 3-diameter center-to-center spacing.

17. The furnace of claim 1 wherein the refractory radiation reflectors are spaced from the tubes to form an open longitudinal flue gas passage for convection heat transfer.

18. The furnace of claim 1 wherein the refractory radiation reflectors are free from attachment to the tubes.

19. The improvement of claim 7 wherein the refractory radiation reflectors are spaced from the tubes to form an open longitudinal flue gas passage for convection heat transfer.

20. The improvement of claim 19 wherein the refractory radiation reflectors are free from attachment to the tubes.

21. The method of claim 10 comprising spacing the refractory radiation reflectors from the tubes to form an open longitudinal flue gas passage for convection heat transfer.

22. The method of claim 21 wherein the installation of the refractory radiation reflectors is free from attachment thereof to the tubes.

* * * * *